United States Patent [19]

Prutton

[11] 4,195,507

[45] Apr. 1, 1980

[54] THREAD ROLL TIMING

[75] Inventor: Edward A. Prutton, Westlake, Ohio

[73] Assignee: Prutton Corporation, Cleveland, Ohio

[21] Appl. No.: 948,696

[22] Filed: Oct. 5, 1978

[51] Int. Cl.[2] ..... B21H 3/04

[52] U.S. Cl. ..... 72/93

[58] Field of Search ..... 72/93, 92, 91, 103, 72/104

[56] References Cited

U.S. PATENT DOCUMENTS

| | | | |
|---|---|---|---|
| 328,217 | 10/1885 | Harvey | 72/92 |
| 780,527 | 1/1905 | Replogle et al. | 72/93 |
| 4,088,045 | 5/1978 | Grohoski | 74/813 C |

*Primary Examiner*—Milton S. Mehr

*Attorney, Agent, or Firm*—Louis V. Granger

[57] ABSTRACT

A thread rolling machine is disclosed wherein a continuously adjustable thread means is used to adjust the relative phase timing between two thread rolling dies and the feeding of a workpiece by the feed means. This timing substantially eliminates any mismatch of thead rolling by the two dies. A double ended thread rolling machine is also disclosed with timing of the two dies relative to the feed of a workpiece accomplished at one end of a workpiece and then the continuously adjustable thread means is used to adjust the relative phase timing of the thread rolling operation on the other end of the workpiece. The above description is merely one form of the invention and is not to be construed as limiting on the scope of the invention.

12 Claims, 8 Drawing Figures

THREAD ROLL TIMING

BACKGROUND OF THE INVENTION

Machines to roll a spiral form on a workpiece, for example, a thread form on a workpiece, have been made in various configurations. Reciprocating flat dies have been used as well as planetary machines with one rotary annular die and one stationary arcuate die. Where an elongated cylindrical workpiece was to have threads rolled on both ends of workpieces, the problem of timing of the feed of the workpieces relative to the instantaneous position of the movable dies was greatly complicated. Since it was one workpiece with both ends being thread rolled, this entire workpiece had to be fed simultaneously into the two pairs of thread rolling dies.

In planetary machines it was common to have a rotary feed cam rotationally adjustably secured to a first rotary die. This adjustable cam acted through a cam follower and drove a feed finger so that the phase timing of the feed relative to the instantaneous position of the rotary cam could be adjusted to substantially eliminate any mismatch of rolling the thread on the first end of the workpiece. This fixed the time of feeding the workpiece to both pairs of dies. Then, to adjust the timing of the second pair of dies relative to this predetermined instant of feed of the workpiece, it was common to adjust the longitudinal position of the stationary arcuate die shoe by adding or removing shims in its mount to the base. Since the arcuate die shoe was supported on the machine by a large number, e.g., eight or twelve machine screws, this was a time-consuming set-up procedure to cut and try in the thickness of shims to achieve proper timing. Even in reciprocating flat die machines it was common to longitudinally adjust the position of the stationary die by the use of shims. This also necessitated removal of many machine screws holding such die to the machine.

Accordingly, the problem to be solved is how to achieve quicker and more precise timing of a pair of dies relative to the feed of a workpiece in order to substantially eliminate any mismatch of the thread forms rolled on the workpiece by the two dies.

SUMMARY OF THE INVENTION

This problem is solved by a work rolling machine to roll a spiral form on a workpiece, comprising, in combination; a base, a rotary first work rolling die rotatably journalled on said base, a complementary second work rolling die mounted on said base to cooperate with said rotary die for rolling a spiral form on a workpiece, feed means connected to feed successive workpieces to an entrance area of said second die, means to adjust the relative phase timing of the dies and the feeding of a workpiece by said feed means in order to substantially eliminate any mismatch of spiral rolling by said dies, and said timing means including a continuously adjustable thread means to relatively adjust the longitudinal position of said dies.

This problem is also solved by a double work rolling machine to simultaneously roll two parts of an elongated workpiece, comprising, in combination; a base, a rotary first work rolling die rotatably journalled on said base, a second work rolling die mounted on said base complementary to said first die for work rolling a spiral form on one part of a workpiece, a rotary third work rolling die rotatably journalled on said base, a fourth work rolling die mounted on said base complementary to said third die for work rolling a spiral form on another part of the workpiece, feed means connected to feed successive workpieces to an entrance area of said second and fourth complementary dies, first means to adjust the relative phase timing of the first and second dies and the feeding of a workpiece by said feed means in order to substantially eliminate any mismatch of spiral rolling by said first and second dies, second means to adjust the relative phase timing of said third and fourth dies and the feeding of a workpiece by said feed means in order to substantially eliminate any mismatch of spiral rolling by said third and fourth dies, and said second timing means including a continuously adjustable thread means to adjust the relative longitudinal position of said third and fourth dies.

An object of the invention is to provide a thread rolling machine with continuously adjustable thread means for timing of the thread rolling dies relative to the workpiece feed.

Another object of the invention is to provide a timing for a thread rolling machine which may be adjusted with the machine in motion.

Another object of the invention is to provide a double ended thread rolling machine wherein the timing of the second pair of dies is accomplished in no more time than the timing of the first pair of dies.

Other objects and a fuller understanding of this invention may be had by referring to the following description and claims, taken in conjunction with the accompanying drawings, in which:

DESCRIPTION OF THE PREFERRED EMBODIMENTS

Figure 1:
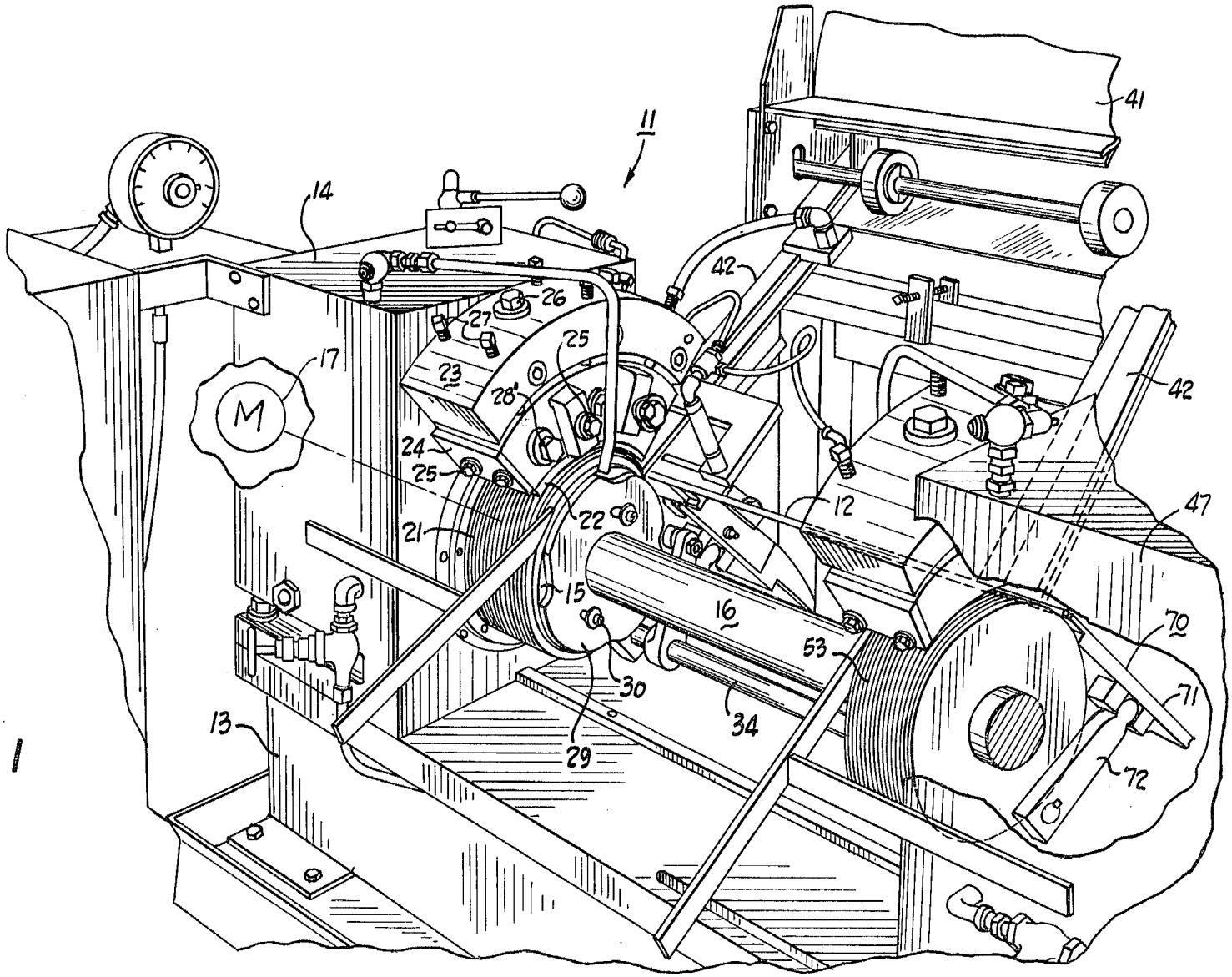
FIG. 1 is a frontal perspective view of a thread rolling machine embodying the invention.

The drawing FIGS. 1–4 show a preferred embodiment of the invention incorporated in a double ended thread rolling machine 11. This machine is used to roll a spiral form on a workpiece, for example, spiral nails or wood screws, but, as shown, is set up to roll threads which are axially parallel, e.g., machine screw threads. Further, the machine rolls not only at one place on a workpiece, but at two different work places and, as shown, this is generally at the two ends of an elongated cylindrical workpiece 12. The machine 11 includes a base 13 having a stationary head 14 secured thereto. A spindle 15 is rotatably journalled in the head 14 by being fixedly secured to a drive shaft 16. This shaft is driven by a motor 17 in the head 14. This motor may be a hydraulic motor, for example, for easy control of the speed.

A rotary first thread rolling die 21 is fixedly secured on the spindle 15. This die is complementary to and cooperates with an arcuate second die 22. This die may be convex and rotary, but as shown is concave and stationary. An arcuate die shoe mount 23 is fixed on the head 14. The arcuate second die 22 is secured to a die shoe 24 by screws 25. The die shoe 24 is adjustably secured to the die shoe mount 23 by machine screws 26 which pull the die shoe 24 toward the mount 23, and by screws 27 which push the die 22 away from the mount 23. After radial adjustment, screws 28' secure the die shoe 24 to the head 14 in an adjustable manner. By proper adjustment of these screws 26 and 27, the proper spacing between the working faces of the dies 21 and 22 may be achieved to roll the proper depth of thread in the workpiece 12.

Figure 2:
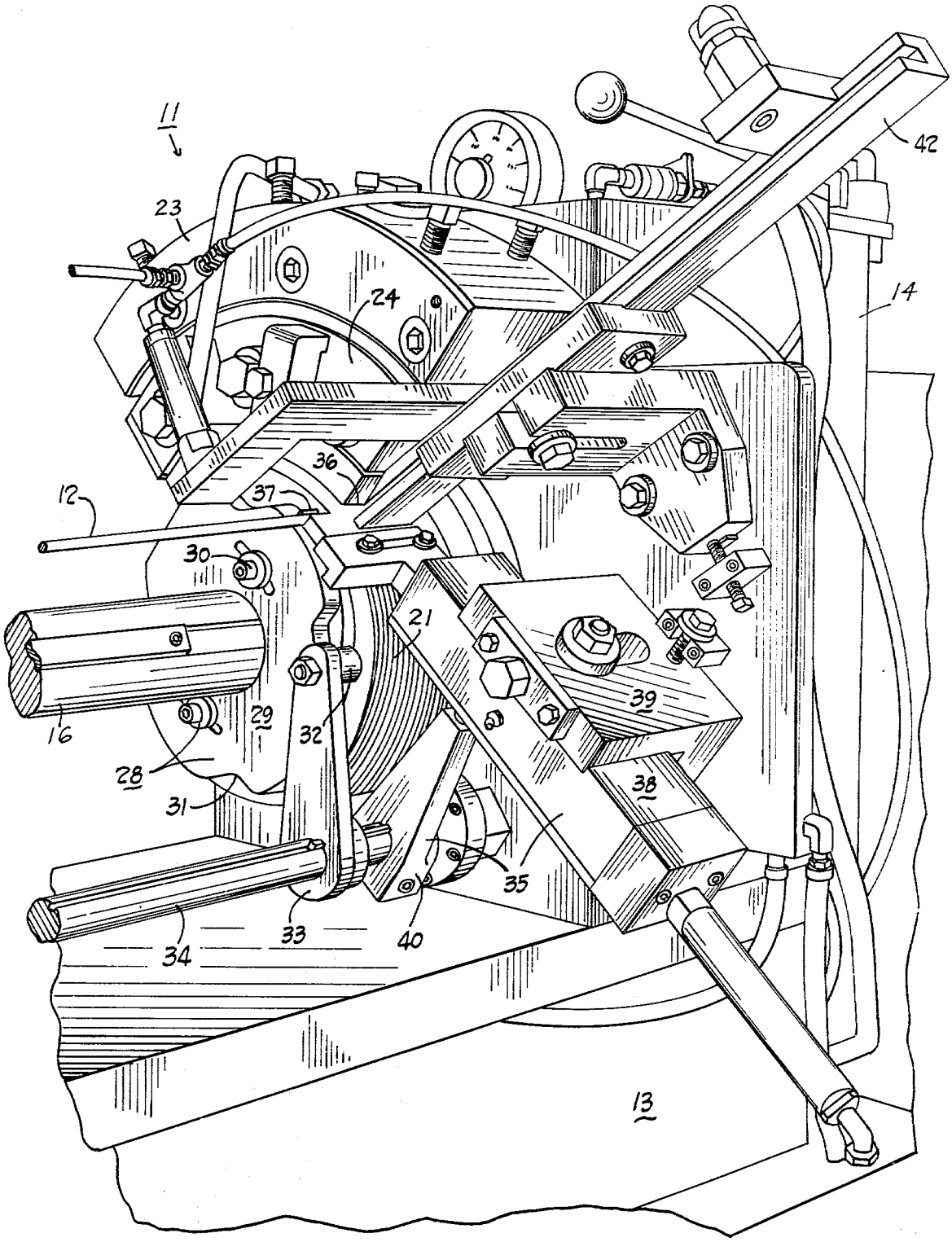
FIG. 2 is an enlarged perspective view of the stationary head of the machine.
Figure 3:
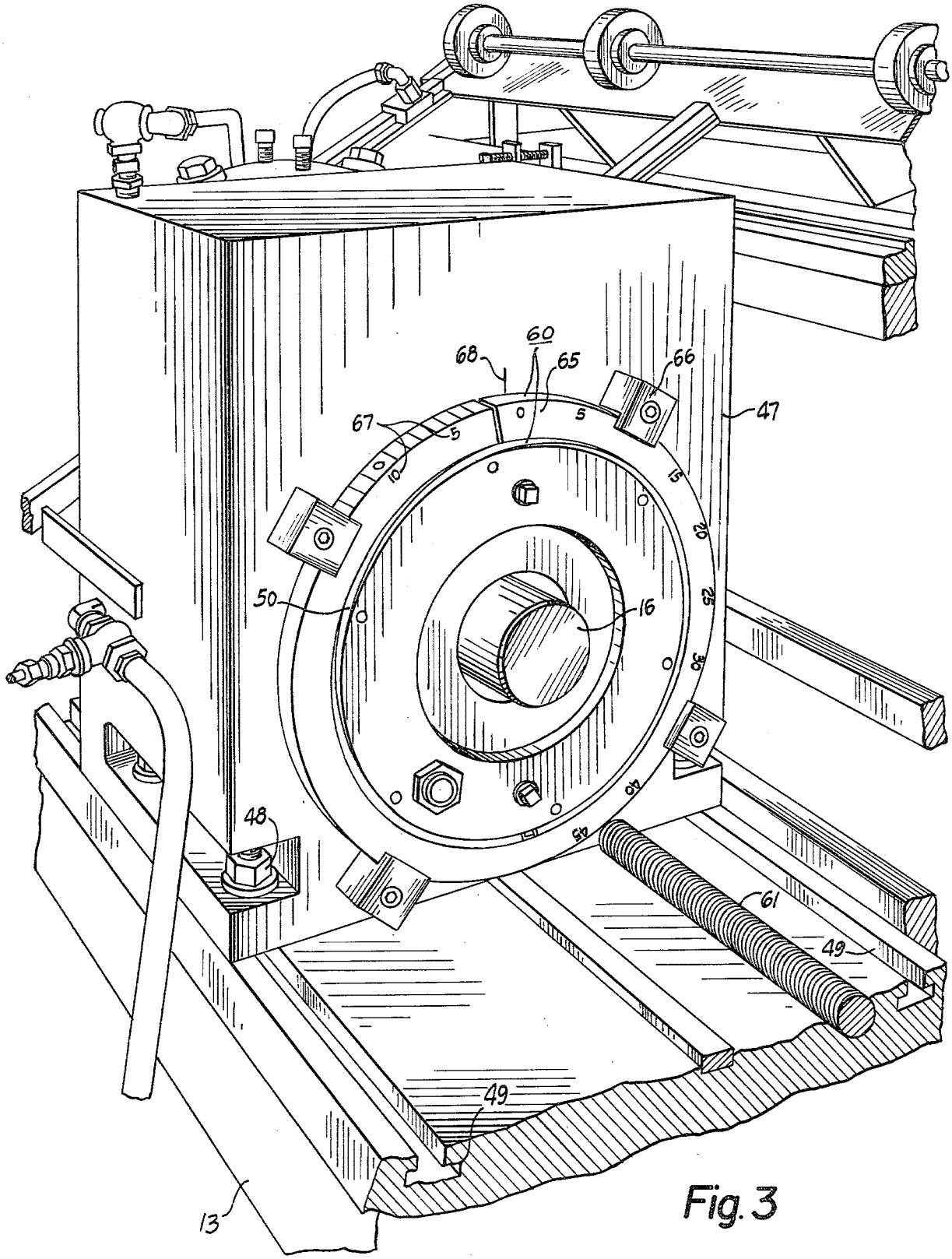
FIG. 3 is an enlarged perspective view of the outer end of the adjustable head of the machine.
Figure 4:
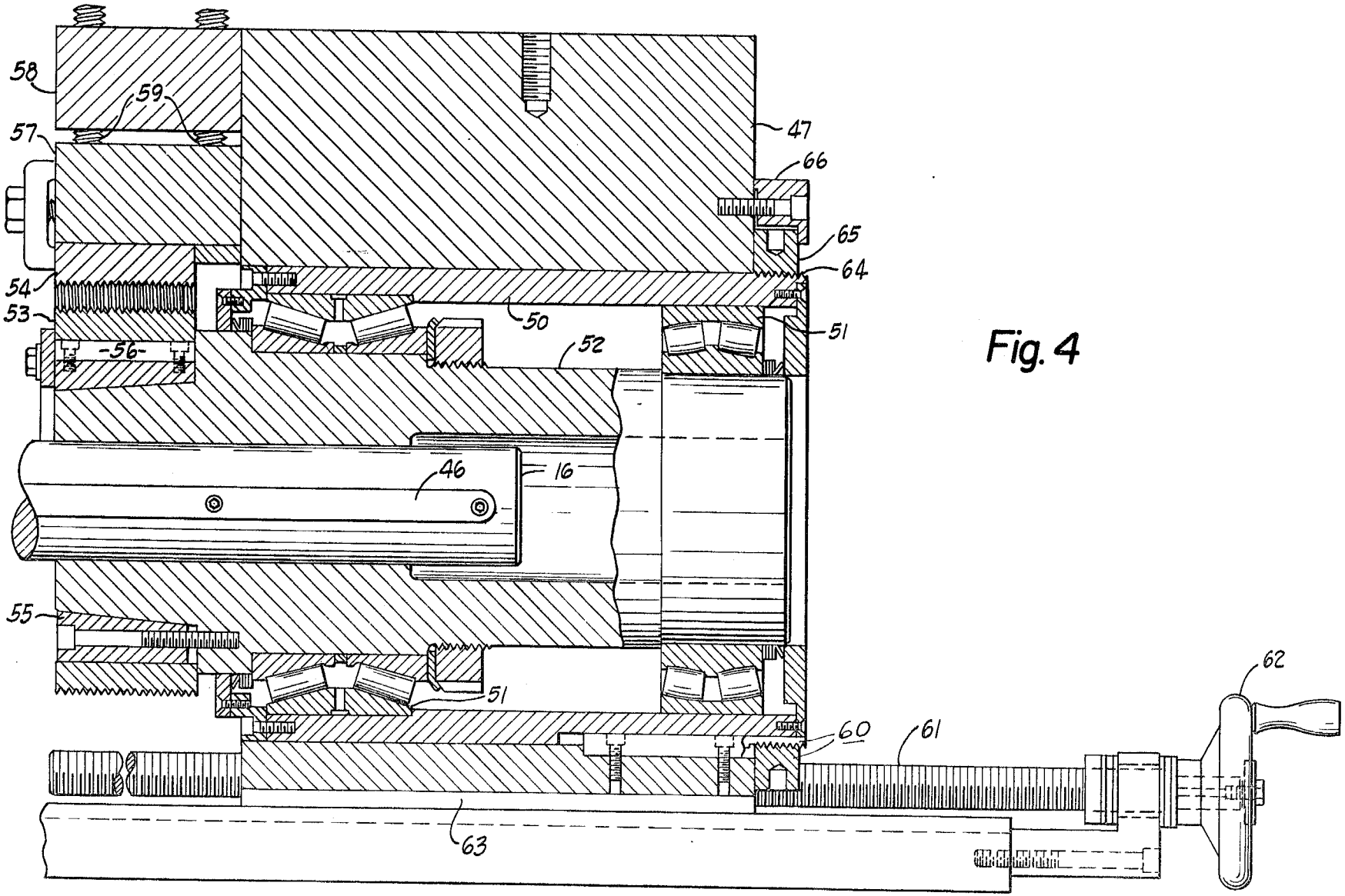
FIG. 4 is a longitudinal sectional view of the adjustable head.

First timing means 28 is provided for the timing of the first dies 21 and 22. This includes a feed cam 29 adjustably secured to the end face of the spindle 15 by timing adjustment screws 30 acting in arcuate slots. This feed cam has one or a plurality of workpiece feed notches 31 and four such feed notches are shown as an illustration. FIG. 2 better shows a cam follower 32 carried on a feed lever 33 fixed on a common rocker shaft 34 which is journalled in the machine 11. The feed cam and cam follower are part of a feed means 35 to feed successive workpieces to the entrance end 36 of the second die 22. This feed means includes a feed finger 37 which resiliently grips the workpiece 12 and is moved by a feed slide 38. This feed slide moves in a slide block 39 adjustably fixed on the base 13 to position the feed finger 37 properly for different workpieces. The slide 38 is reciprocated toward and away from the die 22 by a lever 40 fixed on the rocker shaft 34. Workpieces are fed to the feed finger 37 from a magazine 41 via a chute 42. The magazine is shown removed in FIG. 2 in order to not obscure parts of the machine. Also, the succession of elongated workpieces normally in the chute 42 have also been removed to show the parts of the machine and only a single workpiece 12 is shown in FIGS. 1 and 2 held in the feed finger 37 ready for movement into the nip between the dies at the entrance end 36 of die 22.

Where the workpiece 12 to be worked upon is to be thread rolled, for example, in two places, then the machine 11 accommodates a second thread rolling structure. This is shown in FIGS. 1, 3 and 4 as an adjustable head 47 secured to the base 13 by bolts and nuts 48. The heads of these bolts ride in T-slots 49 in the base 13. The head 47 carries a longitudinally adjustable quill 50 and bearings 51 inside this hollow quill journal a spindle 52. The spindle is slidably secured by a key 46 to the common drive shaft 16. The spindle 52 carries a rotary third die 53. This die 53 is complementary to and cooperates with a fourth die 54. To be consistent with the head 14, die 54 is a stationary arcuate die. The rotary third die 53 may be secured to the spindle 52 in any manner suitable to achieve concentricity and transfer of the necessary torque. As shown, arcuate tapered segments 55 are secured to the spindle 52 and provide the concentricity to the die 53, and a key 56 transfers the torque. The fourth die 54 is secured to the adjustable head 47 in a manner similar to the way in which the second die 22 is secured to the head 14, namely, by means of a die shoe 57 and a die shoe mount 58 with suitable securing and adjusting screws 59.

An adjusting screw 61 is journalled relative to the base and turned by a handwheel 62 to be threaded relative to a nut 63 secured to the adjustable head 47. Loosening the nuts 48 permits the head 47 to be adjusted longitudinally by turning the handwheel 62 for longitudinal movement of the die pair 53, 54 relative to the die pair 21, 22. This adjusts for different lengths of workpieces.

Second timing means 60 is provided to adjust the relative phase timing of the dies 53, 54 and the feeding of a workpiece 12 by the feed means 35. This timing means includes an external thread 64 on quill 50 meshing with an internally threaded nut 65. Clamps 66 may be loosened to permit turning of the nut 65 and may be tightened to axially clamp the nut 65 to the head 47. Indicia 67 on the nut 65 cooperates with an index marked 68 on the head 47.

Second feed means 70 is provided to feed the second end of the workpiece 12 to the entrance end of the fourth die 54. This feed means 70 includes a feed slide 71 slidable by means of a feed lever 72 fixed on the common rocker shaft 34. Thus, both ends of the workpiece 12 are fed simultaneously into the nip of the respective pairs of dies.

Operation

Figure 6:
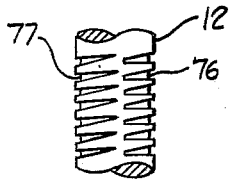
FIG. 6 is a plan view of a workpiece partially rolled with mismatched threads.

In the set-up of the machine 11 for thread rolling two ends of the workpiece 12, the usual procedure is to time the first and second dies 21 and 22 and then time the third and fourth dies 53 and 54. The relative timing of the dies 21, 22 and the feed means 35 may be accomplished by adjusting the rotational position of the feed cam 29 by loosening the screws 30 and rotating the cam 29 on the spindle 15. Since the cam follower 32 is in a fixed circumferential position due to the rocker shaft 34, rotatably changing the secured position of the feed cam 29 changes the relative phase timing of the workpiece feed and the dies 21, 22. FIG. 8 is a developed view of part of the rotary die 21 showing the pitch dimension 74 between adjacent thread crests and showing the peripheral dimension 75 between starts of the thread crests along an edge of the die. This peripheral dimension 74 would be equal to the circumference of the workpiece 12 for a single start thread. When the machine is first set up, the timing is not known. A workpiece 12 is fed by the feed means 35 and 70 into the nip of the dies 21, 22 at the entrance end 36 and the machine jogged for about a one-half planetary rotation of the workpiece 12. It is then reversed to retrieve the workpiece. The workpiece will usually appear as shown in FIG. 6 wherein the threads 76 rolled by die 21 and thread 77 rolled by die 22 are mismatched. The maximum amount of mismatch of the dies is one-half of the pitch dimension 74 or also one-half of the peripheral dimension 75. The screws 30 may be loosened and the feed cam 29 arcuately moved to change the timing. When the cam 29 has been adjusted the proper amount and the screws 30 tightened, the workpiece 12 appears as in FIG. 7 wherein any mismatch between the die marks 76 and 77 is substantially eliminated.

The feed means 35 and 70 must necessarily feed both ends of the workpiece 12 to the entrance ends of dies 22 and 54 simultaneously, else the workpiece 12 will be skewed as it moves through the pairs of dies. Accordingly, it is not practical for the second timing means 60 to adjust the timing of the feed of the workpiece 12 relative to the dies 53, 54. Instead, the present invention contemplates adjusting the timing of the dies 53, 54 relative to the pre-established timing of the feed of the workpiece. The timing means 60 accomplishes this function. This timing means includes the continuously adjustable thread means 64, 65. The clamps 66 may be loosened and the nut 65 rotated, as by a spanner wrench, to axially move the quill 50 and die 53. The amount of movement may be shown by the indicia 67. For example, if the thread 64 is ten threads per inch, then one revolution of the nut 65 provides 0.100 inches of adjustment. The indicia 67 may indicate thousandths of an inch directly for precise, quick and vernier-like adjustments. The timing adjustment may be made in no more time than the timing of the dies 21, 22 relative to feed means 35. Movement of the quill 50 longitudinally moves the rotary third die 53 longitudinally and this will change the timing of the two dies 53 and 54 relative to the workpiece feed in a continuously adjustable manner. The timing adjustment may be made while the machine is running and the clamps 66 tightened to assure retention of the adjusted timing.

Figure 7:
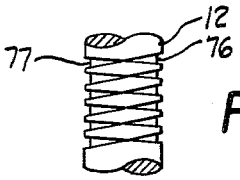
FIG. 7 is a plan view of a workpiece rolled with matching threads.
Figure 8:
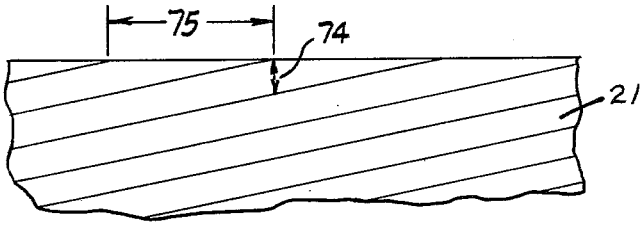
FIG. 8 is an enlarged developed view of part of the rotary die.

The FIGS. 6 and 7 show that the maximum mismatch of the two dies 53 and 54 is one-half the thread pitch 74 of FIG. 8. Accordingly, this is the maximum amount that the quill 50 will have to be longitudinally moved. This may be accomplished easily by only a small movement of the nut 65, usually less than half a revolution.

Figure 5:
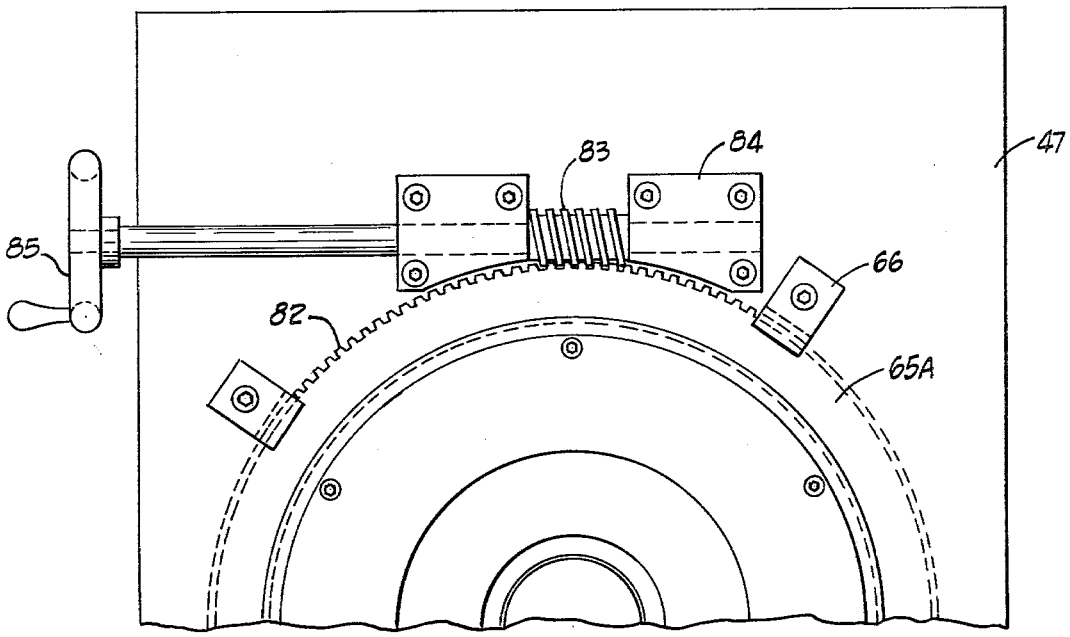
FIG. 5 is an end elevational view of the adjustable head showing a modification.

FIG. 5 shows a modification of the thread means to provide the continuous adjustment of the relative phase timing. The nut 65A has worm gear teeth 82 on the periphery thereof engaged by a worm 83 which is journalled in blocks 84 on the adjustable head 47. A handwheel 85 may be connected to the worm 83 to rotate it and, hence, rotate the nut 65A when the clamps 66 are loosened. In this case of FIG. 5, the worm 83 and worm wheel 82 may be considered a continuously adjustable thread means to adjust the relative phase timing of the dies 53, 54 and the second feed means 70.

If only a single part of the workpiece 12 is intended to be rolled with a thread form, then only the head 47 may be used, for example, with the timing adjusted by means of the adjustable quill 50 as shown for FIG. 3 of FIG. 5.

Either the stationary head 14 or the adjustable head 47 may have the first timing means 28, and the other head may have the second timing means 60.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

I claim:

1. A work rolling machine to roll a spiral form on a workpiece, comprising, in combination; a base, a head carried on said base, a hollow quill longitudinally movable in said head, a drive shaft journalled in said quill, a rotary first work rolling die secured for rotation on said drive shaft, a complementary second work rolling die mounted on said base to cooperate with said rotary die for rolling a spiral form on a workpiece, feed means connected to feed successive workpieces to an entrance area of said second die, means to adjust the relative phase timing of the dies and the feeding of a workpiece by said feed means in order to substantially eliminate any mismatch of spiral rolling by said dies, and said timing means including a male thread on said quill and a nut threaded on said male thread on said quill and acting on said head for longitudinal adjustment of said quill and rotary first die.

2. A work rolling machine as set forth in claim 1, wherein said timing means includes a single pair of coacting threaded parts connected for continuous adjustment of the timing.

3. A work rolling machine as set forth in claim 1, including clamp means acting between said nut and said head.

4. A double work roll machine to simultaneously roll two parts of an elongated workpiece, comprising, in combination; a base, a rotary first work rolling die rotatably journalled on said base, a second work rolling die mounted on said base complementary to said first die for work rolling a spiral form on one part of a workpiece, a rotary third work rolling die rotatably journalled on said base, a fourth work rolling die mounted on said base complementary to said third die for work rolling a spiral form on another part of the workpiece, feed means connected to feed successive workpieces to an entrance area of said second and fourth complementary dies, first means to adjust the relative phase timing of the first and second dies and the feeding of a workpiece by said feed means in order to substantially eliminate any mismatch of spiral rolling by said first and second dies, second means to adjust the relative phase timing of said third and fourth dies and the feeding of a workpiece by said feed means in order to substantially eliminate any mismatch of spiral rolling by said third and fourth dies, and said second timing means including a continuously adjustable thread means to adjust the relative longitudinal position of said third and fourth dies.

5. A double work rolling machine as set forth in claim 4, wherein said thread means is connected to longitudinally move said rotary third die.

6. A double work rolling machine as set forth in claim 4, including a head carried on said base, a spindle mounting said third die and journalled in said head, and said thread means connected to adjust the longitudinal position of said spindle and said third die.

7. A double work rolling machine as set forth in claim 6, wherein said thread means is connected to adjust the longitudinal position of said spindle relative to said head.

8. A double work rolling machine as set forth in claim 7, including a hollow quill in said head, said spindle being journalled inside said quill, and said thread means longitudinally moving one of said quill and said spindle.

9. A double work rolling machine as set forth in claim 8, wherein said thread means includes a male thread on said quill and a female theaded nut connected to be rotatable relative to said head.

10. A double work rolling machine as set forth in claim 9, including means to clamp said nut to said head.

11. A double work rolling machine as set forth in claim 4, wherein said thread means includes a nut, and apertures in said nut engageable by a spanner wrench to rotate said nut.

12. A double work rolling machine as set forth in claim 4, wherein said thread means includes a threaded nut, worm wheel teeth on said nut, and a worm gear engageable with said worm wheel teeth and rotatable to rotate said nut.

* * * * *